United States Patent [19]

Bodine

[11] 4,393,932

[45] Jul. 19, 1983

[54] METHOD AND APPARATUS FOR UNIFORMLY PACKING GRAVEL AROUND A WELL CASING OR LINER

[76] Inventor: Albert G. Bodine, 7877 Woodley Ave., Van Nuys, Calif. 91406

[21] Appl. No.: 243,846

[22] Filed: Mar. 16, 1981

[51] Int. Cl.[3] ..... E21B 33/13

[52] U.S. Cl. ..... 166/249; 166/278; 166/51

[58] Field of Search ..... 166/249, 278, 276, 51, 166/177

[56] References Cited

U.S. PATENT DOCUMENTS

| | | | |
|---|---|---|---|
| 2,871,943 | 2/1959 | Bodine | 166/249 |
| 3,016,093 | 1/1962 | Bodine | 166/249 |
| 3,557,875 | 1/1971 | Solum et al. | 166/278 X |
| 3,905,421 | 9/1975 | Jordan | 166/51 |

*Primary Examiner*—Stephen J. Novosad
*Assistant Examiner*—Thuy M. Bui
*Attorney, Agent, or Firm*—Edward A. Sokolski

[57] ABSTRACT

A method and apparatus for uniformly packing gravel around the perforated region of an oil or water well casing or liner. Sonic elastic wave energy generated by means of an orbiting mass oscillator is transmitted down a pipe string to the region of a perforated well casing or liner around which gravel has been poured to prevent sand and other foreign material from entering the liner or casing or clogging up the apertures thereof. The sonic energy vibrationally excites the gravel to effect the fluidization thereof with a resultant uniform distribution of the gravel around the casing without any voids therein. When the gravel has been so uniformly distributed and the sonic energy is discontinued, the gravel tends to pack down firmly and uniformly around the casing.

8 Claims, 6 Drawing Figures

METHOD AND APPARATUS FOR UNIFORMLY PACKING GRAVEL AROUND A WELL CASING OR LINER

This invention relates to the maintenance and servicing of oil and water well casings, and more particularly to a method and apparatus for effectively installing gravel filter material around such a casing.

In the installation of oil and water wells, perforations are placed in the bottom of the well casing to permit the passage of the desired liquid material, but to prevent the flow into the casing of foreign material, such as sand, tarry material and other undesirable foreign material which may be in the earthen formation. As an additional aid in preventing such foreign matter from entering the casing or liner or clogging up the perforations thereof, an annular layer of tightly packed fine gravel is installed around the apertured portions of the casing, the gravel being fine enough to effectively filter out the foreign material, but not so fine as to itself pass through the perforations in the casing.

A significant problem has been encountered in the installation of such gravel pack in obtaining a complete fill of the annular space around the casing with an absence of voids therein. With the installation techniques of the prior art, it is quite difficult in most installations to attain such uniform distribution of the gravel without voids being formed in view of the limited space available around the perforated well inner or casing. The presence of such undesirable voids in the gravel packing tends to permit passage through the perforations of said particles, tarry substances and other undesirable contaminants, which can cause serious damage to the well pump. Further, such contaminants often clog up the casing perforations cutting down the well flow.

BRIEF SUMMARY OF THE INVENTION

The method and apparatus of this invention overcome the aforementioned shortcomings of the prior art by employing sonic elastic wave energy which may be at a resonant frequency of the vibratory system to fluidize the gravel material which effectively causes it to uniformly distribute itself in an annulus around the casing or lining and pack down with an absence of voids therein. In implementing the present invention, typically a sonic oscillator employing eccentric mass rotors is used to generate vibratory energy of the order of 50–100 hz. This sonic energy is coupled from the oscillator to the pipe string of the well which transmits the energy to the region of the perforated portion of the well casing or liner around which area of the casing or liner the gravel has already been installed in the form of an annulus (typically to a length of 40–60 feet). The sonic energy fluidizes the gravel and distributes it evenly and uniformly around the casing such that void spots are obviated. When the sonic energy is terminated, the gravel is found to have settled into a tightly packed configuration for optimum filtering action.

It is therefore an object of the invention to improve the filtering out of foreign material from well casings.

It is a further object of this invention to provide an improved method and apparatus for uniformly distributing and compacting filtering gravel around the perforated portions of well casings and liners.

Other objects of this invention will become apparent as the description proceeds in connection with the accompanying drawings of which:

Figure 1A:
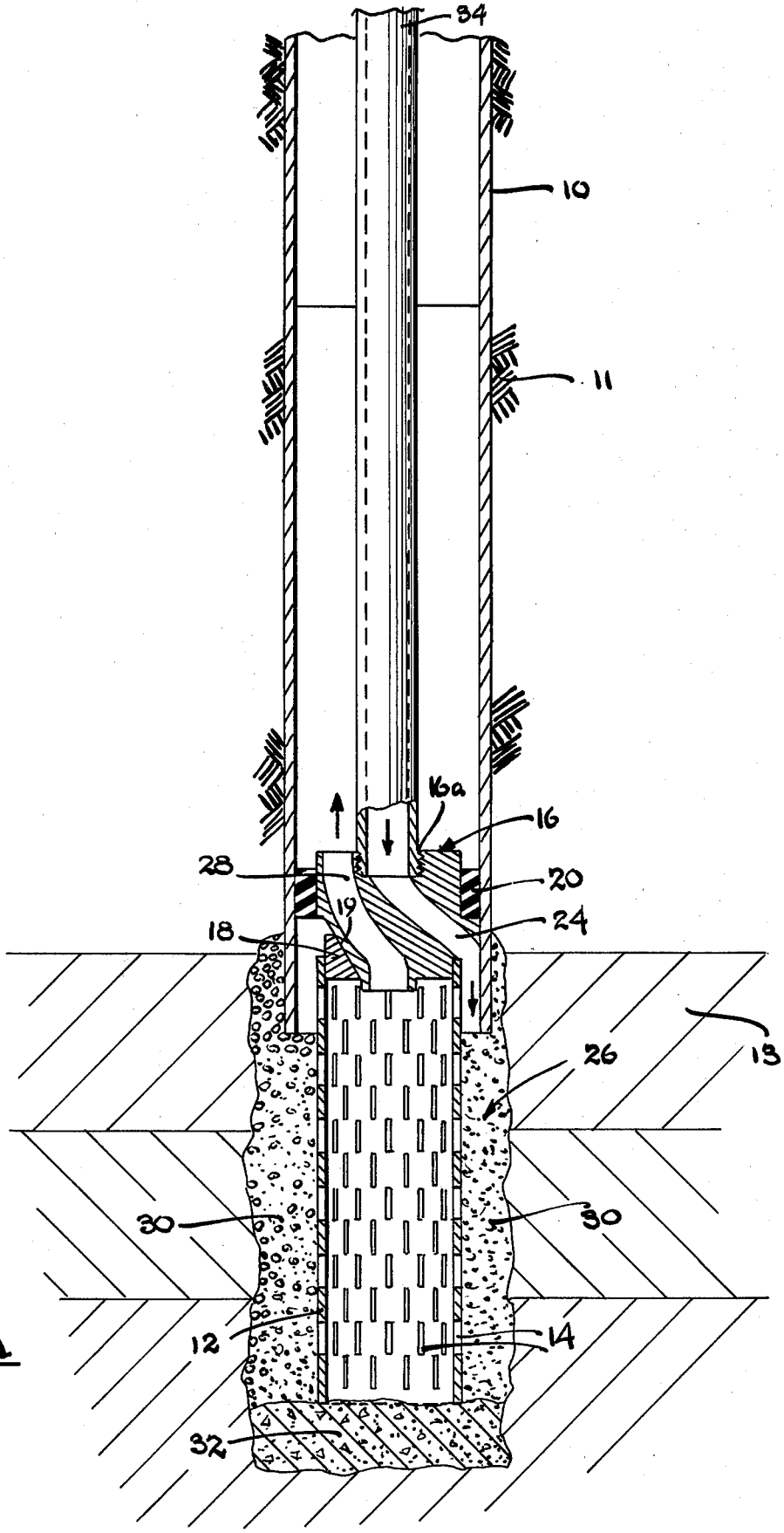
FIGS. 1A and 1B are elevational views of a preferred embodiment of the invention.

It has been found most helpful in analyzing the operation of the device of this invention to analogize the acoustically vibrating circuit involved to an equivalent electrical circuit. This sort of approach to analysis is well known to those skilled in the art and is described, for example, in Chapter 2 of "Sonics" by Hueter and Bolt, published in 1955 by John Wiley and Sons. In making such an analogy, force F is equated with electrical voltage E, velocity of vibration u is equated with electrical current i, mechanical compliance $C_m$ is equated with electrical capacitance $C_e$, mass M is equated with electrical industance L, mechanical resistance (friction) $R_m$ is equated with electrical resistance R and mechanical impedance $Z_m$ is equated with electrical impedance $Z_e$.

Thus, it can be shown that if a member or column is elastically vibrated by means of an acoustical sinusoidal force $F_o \sin \omega t$ ($\omega$ being equal to $2\pi$ times the frequency of vibration), $$Z_m = R_m = j\left(\omega M - \frac{1}{\omega C_m}\right) = \frac{F_o \sin \omega t}{u} \quad (1)$$

Where $\omega M$ is equal to $1/\omega C_m$, a resonant condition exists, and the effective mechanical impedance $Z_m$ is equal to the mechanical resistance $R_m$, the reactive impedance components $\omega M$ and $1/\omega C_m$ cancelling each other out. Under such a resonant condition, velocity of vibration u is at a maximum, power factor is unity, and energy is more efficiently delivered to a load to which the resonant system may be coupled.

It is important to note the significance of the attainment of high acoustical Q in the resonant system being driven, to increase the efficiency of the vibration thereof and to provide a maximum amount of power for effectively surveying the geological strata. As for an equivalent electrical circuit, the Q of an acoustically vibrating circuit is defined as the sharpness of resonance thereof and is indicative of the ratio of the energy stored in each vibration cycle to the energy used in each such cycle. Q is mathematically equated to the ratio between $\omega M$ and $R_m$. Thus, the effective Q of the vibrating circuit can be maximized to make for highly efficient, high-amplitude vibration by minimizing the effect of friction in the circuit and/or maximizing the effect of mass in such circuit.

In considering the significance of the parameters described in connection with Equation 1, it should be kept in mind that the total effective resistance, mass, and compliance in the acoustically vibrating circuit are represented in the equation and that these parameters may be distributed throughout the system rather than being lumped in any one component or portion thereof.

It is also to be noted that orbiting-mass oscillators are utilized in the devices of the invention that automatically adjust their output frequency and phase to maintain resonance with changes in the characteristics of the load. Thus, in the face of changes in the effective mass and compliance presented by the load with changes in the conditions of the surrounding earthen material as it is sonically excited, the system automatically is maintained in optimum resonant operation by virtue of the "lock-in" characteristic of applicant's unique orbiting-mass oscillators. The vibrational output from such orbiting mass oscillators may be generated along a controlled predetermined coherent path to provide maximum output along a desired axis. The orbiting mass oscillator automatically changes not only its frequency but its phase angle and therefore its power factor with changes in the resistive impedance load to assure optimum efficiency of operation at all times.

DETAILED DESCRIPTION

Figure 1B:
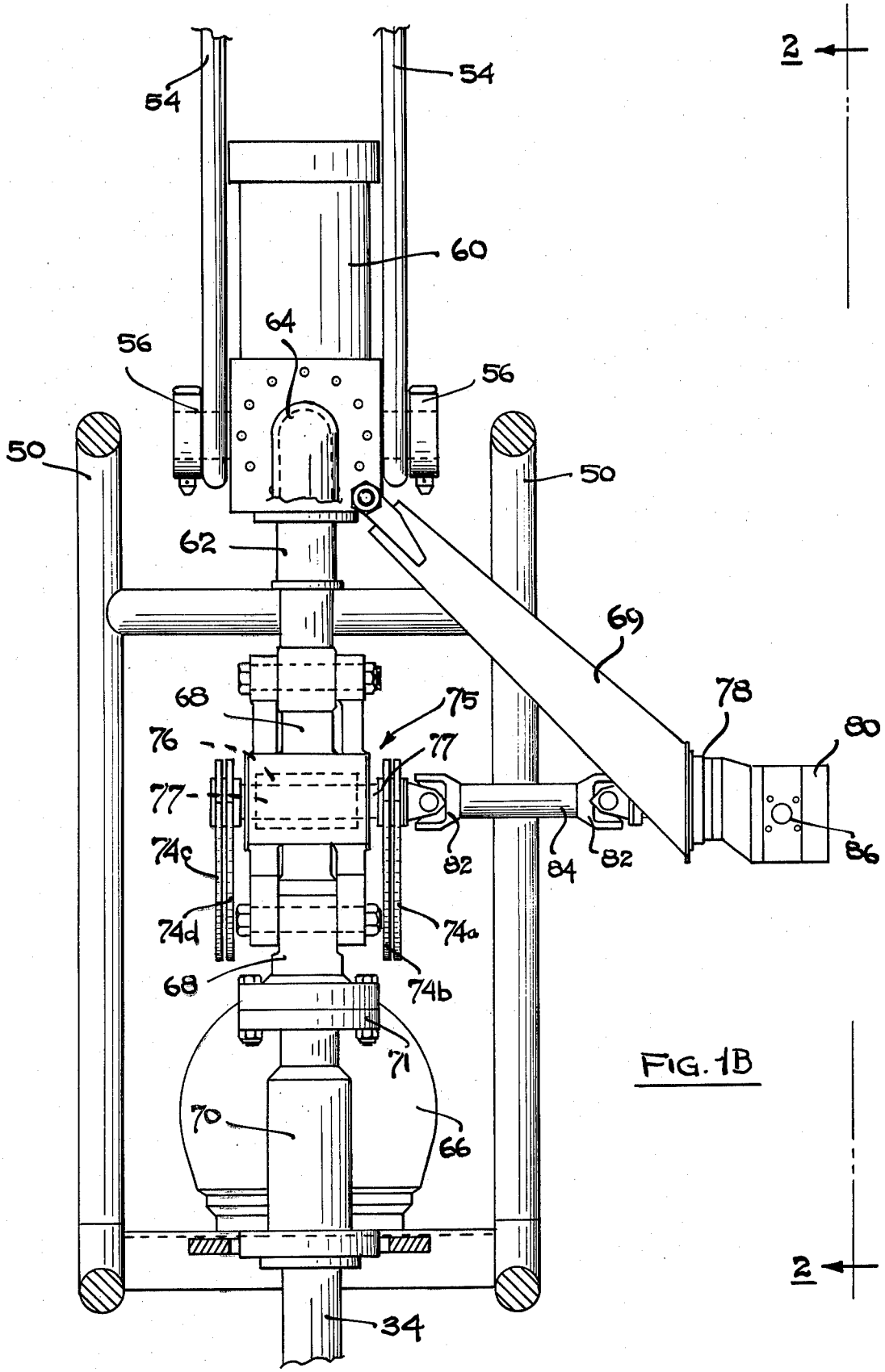

Referring now to FIGS. 1A and 1B, a first embodiment of the invention is illustrated. Casing 10 is intalled through the overburden earthen material 11 to the fluid-producing formation 13 which may yield oil or water as the case may be. Liner 12 has multiple perforations 14 formed therein for permitting the passage of the desired fluid material yet preventing the passage of larger pieces of foreign matter. Liner 12 is installed at the bottom end of casing 10 such that it continues down through the producing formation 13. When first installed, the bottom end of liner 12 may be left open and suspended a short distance above the bottom of the bore hole. The top end of liner 12 has a cross-over and packer tool 16 installed therein, the liner being tightly attached to this tool by means of gripping slips 18 having wedge-shaped surfaces 19 which hold the packer tool and the liner together temporarilly while the liner packing service function is carried on.

Typically, the packer tool 16 and liner 12 are joined together at the surface and the assembly so formed lowered into position, as indicated in FIG. 1A by means of a suitable cable (not shown). Once the liner has been placed in position, drill pipe 34 is threadably connected to a threaded portion 16*a* of the packer tool from the surface, pipe 34 usually being a 4½ inch standard A.P.I. drill pipe. The bottom end of pipe 34 has direct fluid communication with diagonal passageway 24 formed in the packing tool which passageway in turn has fluid communication with the annular spacing between liner 12 and casing 10 and thence to the area 26 in which the gravel is to be installed. A diagonal cross-over passageway 28 runs through packer tool 16 to provide fluid communication between the interior of liner 12 and the interior of casing 10. Cross-over and packer tool 16 includes a packer gland 20 forming an annulus therearound which seals the outer walls of the tool against the inner walls of casing 10.

The gravel pack 30 is installed in the space 26 surrounding liner 12 by flowing a gravel pack slurry down pipe 34 from where it passes through diagonal channel 24 to the area 26. It is to be noted in this regard that the interior of liner 12 is effectively isolated from channel 24 by the structure of the cross-over and packer tool so that no gravel is fed into the interior of the liner. After the space 26 around the liner has been filled with gravel 30, the liquid portion of the gravel slurry enters into the interior of liner 12 through perforations 14 and is discharged out of the liner through cross-over channel 28. It is to be noted in this regard that the perforations 14 are made small enough so that they will not permit the passage of gravel particles therethrough. In certain situations, the bottom end of liner 12 may be closed off by a cement plug 32 or a conventional liner show.

While the gravel slurry is being poured into place in space 26 and for a period of time after such pouring of gravel has been completed, drill pipe 34 is sonically activated by means of sonic elastic wave energy transmitted to the pipe by oscillator assembly 75. This sonic energy, as has already been noted, may be at a resonant frequency such as to effect standing wave vibration of the pipe and vibrationally excites the gravel to effect the fluidization thereof with a resultant uniform distribution of the gravel around the casing without any voids therein and with the gravel packed down firmly and uniformly around the liner. The sonic energy also tends to cleanse the gravel of foreign material.

Figure 2:
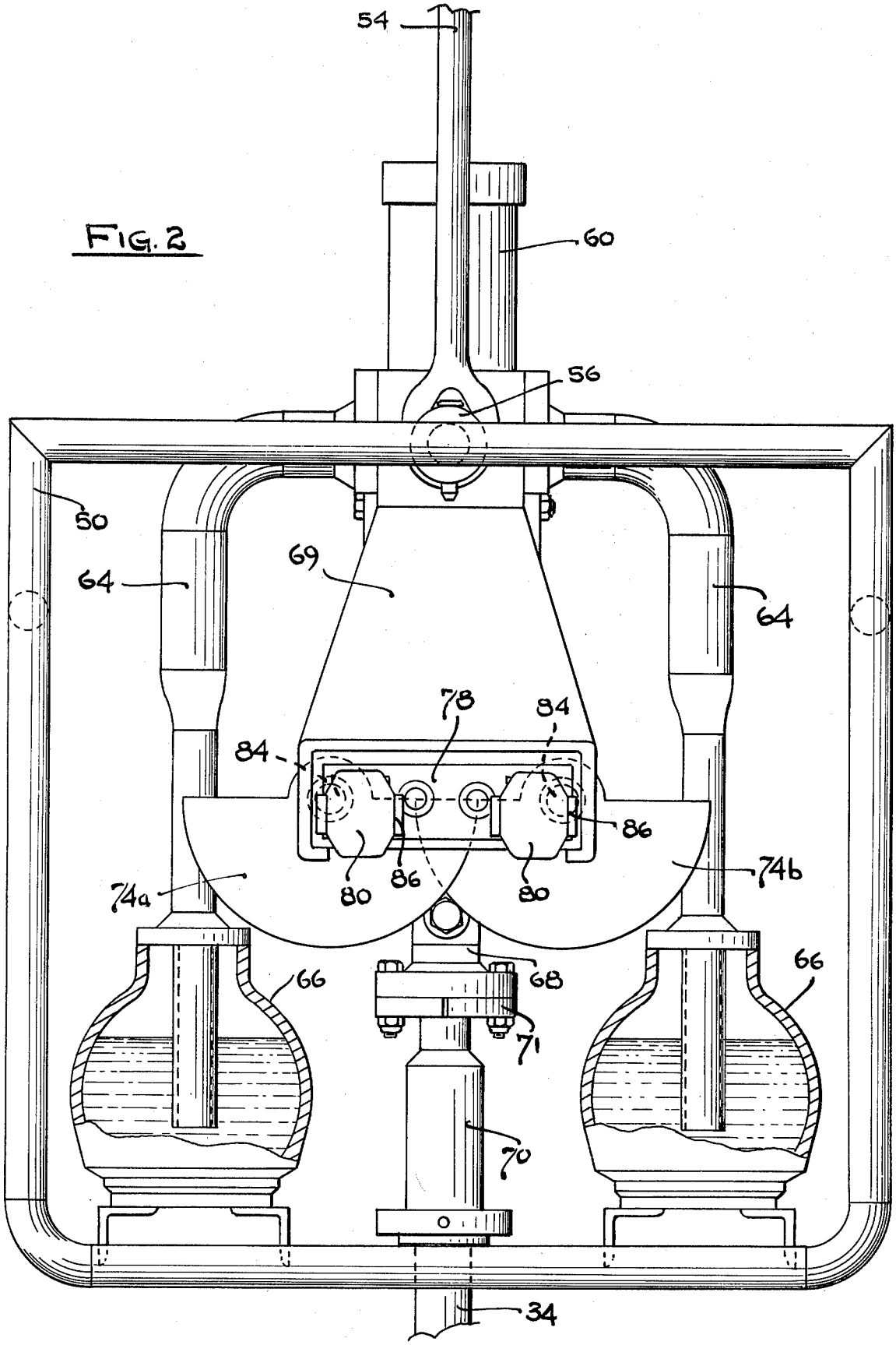
FIG. 2 is a view of the preferred embodiment taken along the plane indicated by 2—2 in FIG. 1B.

Referring now to FIGS. 1B and 2, oscillator assembly 75 comprises two pairs of swinging weights 74*a*, 74*b* and 74*c*, 74*d*, which form eccentric weights of the oscillator and have shafts 77 fixedly attached thereto which are rotatably supported on sleeve bearings 76. The paired oscillator rotors are mounted in symmetrical fashion on opposite sides of the main body portion 68 of the oscillator assembly. The rotors are rotatably driven by means of hydraulic motors 80, the speeds of which are adjusted by hydraulic inflow valves 86, the output drives of the motors being coupled to a phasing gear box 78 which provides rotational output drives in opposite directions to a pair of U-joint assemblies 82 (only one shown). One of U-joint assemblies 82 drives one of the rotors 74*a* and 74*c* of each pair in one direction while the other of the U-joint assemblies drives the other rotor of each pair 74*b* and 74*d* in an opposite direction, these rotational drives being phased so that the rotors of each pair will maintain a 180° positional phase relationship with each other at all times. Hydraulic motors 80 are supported on the support structure by means of support strut 69. The entire assembly is supported from a derrick by means of cables (not shown) attached to links 54 and frame member 50, the central body portion of the assembly being supported from links 54 on carrier trunions 56.

Supported on trunions 56 by means of support links 54 is an hydraulic cylinder 60. Cylinder 60 has a piston (not shown) which is connected to piston rod 62 from which the oscillator assembly 75 is suspended. The piston of cylinder 60 is urged upwardly by means of hydraulic pressure supplied thereto from standard air/-hydraulic accumulators 66 which are connected to the cylinder through hydraulic conduits 64. This effectively provides an air/hydraulic "spring" between the derrick and its associated support structure and the oscillator so that the vibratory energy generated by the oscillator is effectively vibrationally isolated therefrom. The central body portion 68 is connected through a flange plate 71 to clamping jaw 70 which clampingly engages pipe 34. Central body portion 68 is firmly coupled to the rotor bearings 76 so as to receive the vibrational energy generated by the oscillator.

With the rotation of the paired oscillator rotors in opposite directions, vibratory energy is generated in central body portion 68 in a vertical vibratory mode, i.e., along the longitudinal axis of pipe 34. This vertical vibratory energy is transferred to pipe 34 which forms an elastic column and transmitted through the pipe and the cross-over and packing assembly 16 in liner 12 to the gravel pack 30. The frequency of the oscillator may be adjusted to effect resonant standing wave vibration of pipe 34. This will greatly increase the amplitude of the vibratory energy. It is to be noted that the sonic fluidizing effect which the sonic energy has on the gravel pack can be employed for loosening gravel pack, either for cleaning (in the nature of backwashing a filter) or for facilitating pulling the liner from the well.

Once the space 26 is completely, uniformly filled with gravel without any voids formed therein, the drill pipe 34 can be pulled out of the well carrying along with it packer assembly tool 16 which with such upward pulling separates from liner 12 with the release of wedge slips 18 from the liner walls.

Figure 3:
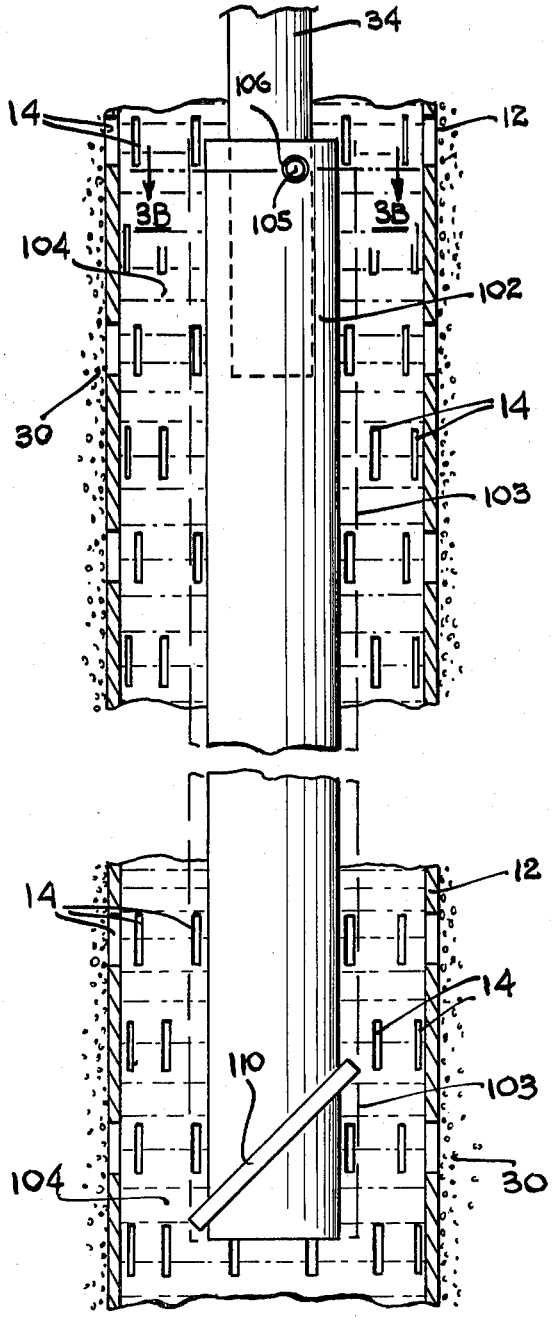
FIG. 3 is a cross-sectional view illustrating a modification of the preferred embodiment wherein lateral vibration is incorporated.
Figure 3B:
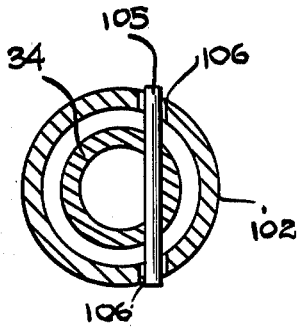
FIG. 3B is a cross-sectional view taken along the plane indicated by 3B—3B in FIG. 3.
Figure 3A:
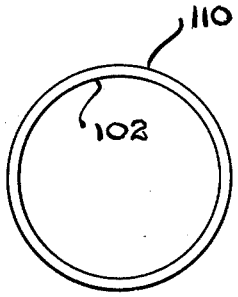
FIG. 3A is a top plan view of the sloping collar employed in the modification of FIG. 3.

Referring now to FIGS. 3, 3A and 3B, a second embodiment of the invention is illustrated. This second embodiment employs the same means for generating the vibrational energy as the first and similarly transmits this energy down a pipe 34. In this second embodiment, however, means are provided for converting the vertical vibrational modes of the energy into lateral vibration modes and this lateral vibrational energy is coupled to the gravel through a liquid medium.

Pipe 34 is coupled to pipe 102 which is externally concentric therewith by means of a pivot pin 105 which is tightly swaged to pipe 34 and loosely fitted through apertures 106 formed in pipe 102. The eccentric location of pivot pin 105 causes an eccentric delivery of vibratory force to pipe 102 in response to the vertical vibratory forces generated in pipe 34 by the oscillator (not shown). The hinge pivot action of pin 105 acting on the bearing in pipe 102 formed by aperture 106 results in cyclic vibratory force which is applied eccentrically with relation to the center of gravity line extending along the axis of pipe 102. This vertical vibration of one concentrated region of pipe 102, this region being located at a considerable distance from the central axis of the pipe, results in a cyclic tipping force being applied to pipe 102 in the region of the pin 105, thereby engendering a lateral vibration of the pipe as indicated by dashed lines 103 in FIG. 3. Liner 12 is filled with liquid 104 which may comprise oil or water, as the case may be, which transmits the lateral vibrational energy from pipe 102 through liner 12 to the gravel 30 to effect the packing thereof, as in the previous embodiment.

The use of lateral vibratory energy is particularly useful in some forms of gravel pack where it is desired to obtain maximum penetration back into the gravel. Also, the use of lateral vibratory energy transmitted through a liquid is desirable in wells having a perforated liner of relatively delicate construction, such as in the case of wire-wrapper liners, which cannot handle high level vibration as well as more ruggedly constructed liners.

To further enhance the generation of lateral vibration in pipe 102, a sloping collar 110 is placed over pipe 102 near the bottom end thereof. This sloping collar reacts against the liquid 104 to further induce the lateral vibration of the pipe. Such a sloping collar device is particularly useful where pipe 102 is of considerable length.

It is to be noted that the apparatus described in my copending application Ser. No. 139,403, filed Apr. 11, 1980, for "Apparatus and Method for Coupling Sonic Energy to the Bore Hole Wall of an Oil Well to Facilitate Oil Production" could also be employed for the purpose of delivering sonic energy for packing or loosening gravel pack around a perforated portion of an oil well liner or casing, and this prior application is incorporated herein by reference as a further embodiment of a sonic generator which may be used in carrying out the method of the present invention.

It is further to be noted that the sonic energy also cleans the gravel layer and aids in the extraction of the liner when such is to be performed.

While the invention has been described and illustrated in detail, it is to be clearly understood that this is intended by way of illustration and example only and is not to be taken by way of limitation, the spirit and scope of this invention being limited by the terms of the following claims.

I claim:

1. A method for uniformly packing gravel around the perforated region of a well liner comprising the steps of installing a casing through overburden to a fluid producing formation, installing a liner at the bottom end of said casing in said formation, said liner having apertures therein for passing said fluid to the interior thereof, pouring gravel into the region surrounding said liner to inhibit the flow of foreign material through said apertures into the interior of said liner, generating high level sonic elastic wave energy, and coupling said sonic energy to the gravel through an elastic column coupled to the liner to effect the fluidization thereof and the resultant uniform distribution and compaction of said gravel without voids therein around the liner.

2. The method of claim 1 wherein the gravel is mixed with liquid, the sonic energy being transmitted through liquid in said well to the gravel.

3. An apparatus for uniformly packing gravel around a well liner without voids in said gravel, said liner being installed in the region of a liquid producing formation having apertures formed therein for passing liquid therethrough, a casing extending through overburden to said liner, and an elastic column extending through said casing and coupled to said liner, said apparatus comprising oscillator means for generating sonic elastic wave energy, means for coupling the vibrational output of said oscillator means to said elastic column to effect vibration thereof in a longitudinal vibration mode, and means for suspensively supporting the oscillator means and liner the sonic energy coupled to said elastic column being transmitted to the gravel to effect fluidization and uniform distribution thereof around said liner.

4. The apparatus of claim 3 and further including hydraulic spring means for vibrationally isolating said oscillator means from the oscillator supporting means.

5. The apparatus of claim 4 wherein the means for vibrationally isolating said oscillator means comprises a hydraulic cylinder, a piston mounted in said cylinder on which the oscillator means is suspended, and accumulator means for providing hydraulic pressure to said cylinder to resiliently urge the piston away from the oscillator.

6. An apparatus for uniformly packing gravel around a well liner without voids in said gravel, said liner being installed in the region of a liquid producing formation having apertures formed therein for passing liquid therethrough, a casing extending through overburden to said liner, and an elastic column extending through said casing and coupled to said liner, said apparatus comprising oscillator means for generating sonic elastic wave energy, means for coupling the vibrational output of said oscillator means to said elastic column to effect vibration thereof in a longitudinal vibration mode, and means for converting the longitudinal vibrational mode of said elastic column to a lateral mode of vibration, the sonic energy coupled to said pipe being transmitted to the gravel to effect fluidization and uniform distribution thereof around said liner.

7. The apparatus of claim 6 wherein said means for converting the longitudinal vibration mode to a lateral vibration mode comprises a second elastic column, and pin means tightly attached to said first elastic column at an off-center location on said first elastic column and loosely coupled to said second elastic column at an off-center location thereon.

8. The apparatus of claim 7 and further including a collar member attached to said second elastic column near the free end thereof, said collar member being sloped relative to the longitudinal axis of said second elastic column.

* * * * *